United States Patent [19]

Gaspar

[11] 4,295,757

[45] Oct. 20, 1981

[54] JET SLED SPOIL SCOOP APPARATUS

[76] Inventor: Randal Gaspar, P.O. Box 2352, Morgan City, La. 70380

[21] Appl. No.: 68,919

[22] Filed: Aug. 23, 1979

[51] Int. Cl.[3] ..... E02F 5/02; F16L 1/04

[52] U.S. Cl. ..... 405/163; 405/164

[58] Field of Search ..... 405/161, 163, 164; 37/61-63

[56] References Cited

U.S. PATENT DOCUMENTS

| | | | |
|---|---|---|---|
| 3,368,358 | 2/1968 | Elliott | 405/163 |
| 3,504,504 | 4/1970 | Elliott | 405/163 |
| 3,624,933 | 12/1971 | Faldi | 37/63 |
| 3,751,927 | 8/1973 | Perot, Jr. | 405/163 |
| 4,037,422 | 7/1977 | de Boer et al. | 405/163 X |
| 4,041,717 | 8/1977 | Dressel et al. | 405/163 |
| 4,087,981 | 5/1978 | Norman | 405/163 X |

FOREIGN PATENT DOCUMENTS

| | | | |
|---|---|---|---|
| 189133 | 2/1957 | Austria | 37/62 |

*Primary Examiner*—Stephen J. Novosad

*Attorney, Agent, or Firm*—Charles C. Garvey, Jr.

[57] ABSTRACT

An apparatus for burying a pipeline in a sea bed having a spoil collection scoop surrounding the air lift intake portions of the sled. The apparatus includes a jet sled having jetting legs for disposition on the opposite sides of a pipeline to be buried and directing a stream of high pressure water through nozzles into the sea bed to form a trench for the pipeline, and air lift conduits each providing spoil intake and spoil discharge portions for removing spoil cuttings from the trench cut by the jetting legs. A spoil collection scoop surrounds the intake portions of the air lift conduits, collecting and consolidating spoil cut by the jetting legs at the air lift conduit intake portion for discharge of the cut spoil material from the trench into which the pipe will be buried.

11 Claims, 6 Drawing Figures

JET SLED SPOIL SCOOP APPARATUS

BACKGROUND OF THE INVENTION

1. Field of the Invention

The present invention relates to trench cutting and pipe burying devices for use in an undersea marine environment. The present invention more particularly provides a pipe burying jet sled with an improved spoil removal means which scoops and transmits spoil material cut to the air lift spoil intake portions of the jet sled for subsequent removal from the trench.

2. General Background and Prior Art

Many devices have been patented and have been used commercially for excavating an underwater ditch or trench, with a pipeline which has been welded together and constructed laid in the ditch for subsequent protective coverage a distance beneath the sea bed. Underwater trench cutting devices attempt to solve the problems of properly cutting a ditch of desired depth and shape, of loosening the sea bed material into a spoil which could be removed, and removing the spoil material from the area around the trench so that it does not refill the trench after the jet sled or like device has passed and before pipe is placed in the trench or ditch.

In U.S. Pat. No. 3,504,504 also issued to H. A. Elliot, a similar type eductor tube is utilized to discharge soil cuttings or spoil. The eductor tubes are mounted on a pair of concave jaw scoop members with the jaw scoops channelling cuttings mud and slurry to the eductor tubes. Openings fore and aft allow the pipeline to pass through the pair of jaw scoops which are movably mounted with respect to one another to vary the distance therebetween, allowing the pipe to be placed between the scoop jaws during operation.

U.S. Pat. No. 3,368,358 issued to H. A. Elliot provides a trenching machine which utilizes a pair of scoop jaws similar to those in U.S. Pat. No. 3,504,504 and eductor tube for discharging soil or formation materials cut by the jetting action of the sled.

In U.S. Pat. No. 3,751,927 two vertically oriented eductor pipes discharge spoil and cuttings with the aid of a high pressure fluid conduit. The pressurized fluid is injected into the eductor head tubes to enhance spoil removal.

U.S. Pat. No. 4,041,717 provides a sand shield jet sled which prevents unconsolidated materials such as sand, from entering the sea bed prior to the placement of the pipe to be buried into the trench. Elongated members extending rearwardly of the jet sled and having shields depending therefrom physically restrain the walls of the trench from caving in and filling the trench beneath the unsupported portion of the pipe.

These and other prior art devices suffer in that they fail to provide an adequate means for channelling or transmitting material which has been cut, i.e. spoil, in the area of the discharge of a provided eductor tube or air lift conduit.

Generally, if a channelling means or scoop is provided to move soil cuttings and the like to the air lifts for removal, it is complex, requiring automated winches and cables for its opening and closing when placing or removing the jet sled on a pipeline to be buried.

Since soil cut will usually settle somewhat a scoop should have air lifts at the bottom of the scoop, or soil cuttings will accumulate in that area not occupied by the air lift, effectively clogging the scoop and limiting its effective size and efficiency.

On some prior art type scoops used with jetting legs, the pipeline passes during operation through the scoop, requiring both fore and aft openings in the scoop, which allows the escape of soil cuttings through the aft opening as the sled progresses.

Therefore, it is an object of the present invention to provide a jet sled apparatus which is provided with a simple to operate, efficient spoil collection scoop surrounding the spoil intake portion of the jet sled air lift for consolidating soil cuttings and enhancing their removal from the trench area.

It is another object of the present invention to provide a spoil scoop structure with air lift intakes provided at a lowermost portion of the scoop thereby removing all soil cuttings from the scoop and also removing the chance for soil cutting accumulation in the scoop.

It is another object of the present invention to provide a jet sled and spoil collection scoop having only a forward opening and no opening aft during operation from which spoil collected can escape.

It is another object of the present invention to provide a jet sled and spoil collection scoop apparatus with air lift intake at variable level.

Still another object of the present invention is to provide a jet sled and spoil collection scoop apparatus with the scoop being easily manually opened and closed by a diver allowing easy mounting or dismounting of the apparatus on a pipeline to be buried.

It is another object of the present invention to provide a jet sled for burying pipe in a sea bed which is simple and easy to manufacture.

3. General Description of the Present Invention

The present invention solves all the prior art problems and shortcomings by providing a pipe burying apparatus having a frame with a central pipeline passage allowing a pipeline to be buried to pass therethrough during the burying operation. The frame is adapted for undersea towing and has left and right jetting means mounted on the frame on the left and right sides respectively of the central pipeline passageway, the jetting means cutting a trench in the sea bed with the subsequent placement of a pipeline to be buried therein. Left and right air lift conduits each provides spoil intake and spoil discharge portions for removing soil cuttings from the trench as they are cut by the jetting means, the spoil intake portions being placed generally behind and between the left and right jetting means. A spoil collection scoop is mounted on the frame generally below the central pipeline passageway portion of the frame and surrounding the bottom, sides, and rear portions of the soil intake portions of the air lifts. The spoil collection scoop provides bottom and rear door portions, each of which is movably mounted on the frame between open and closed positions, and each of which can be removed from the frame if desired. The spoil intake portions of the air lifts are mounted in the scoop at the bottom and rear portions thereof solving the problem.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
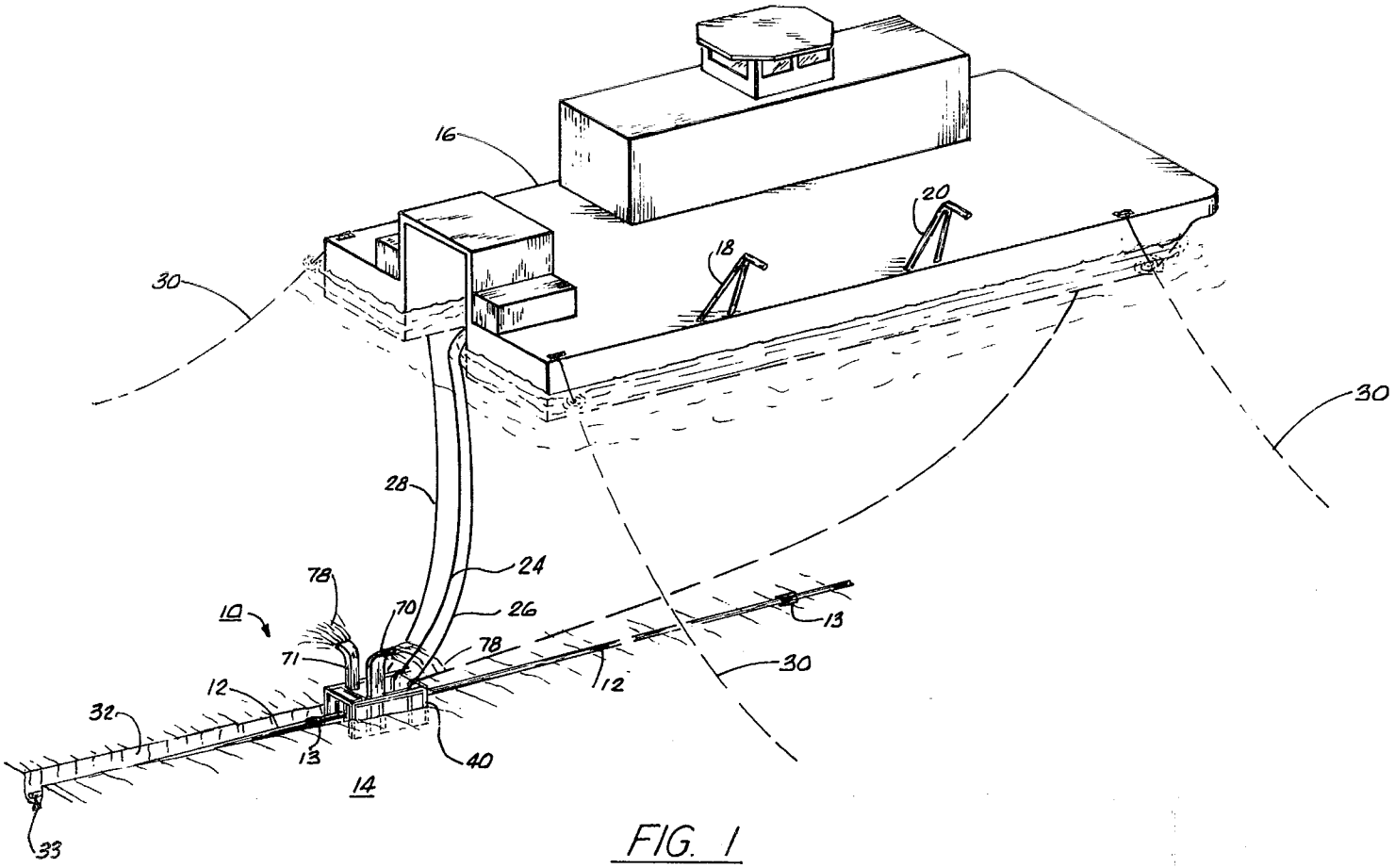
FIG. 1 is a perspective view of the preferred embodiment of the apparatus of the present invention being used in combination with a pull barge while laying a pipeline in a constructed trench in a sea bed.
Figure 2:
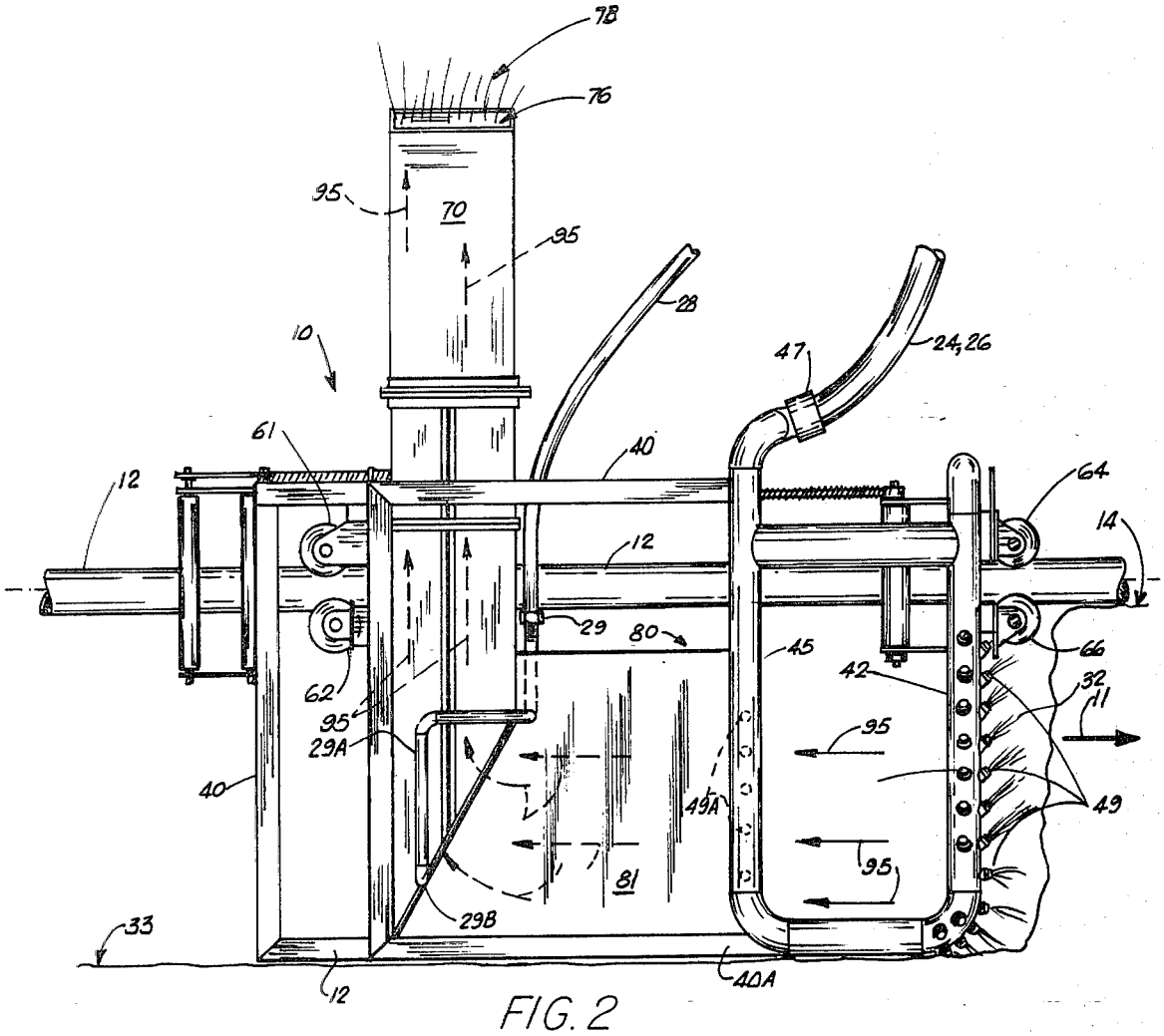
FIG. 2 is a side view of the preferred embodiment of the apparatus of the present invention.
Figure 3:
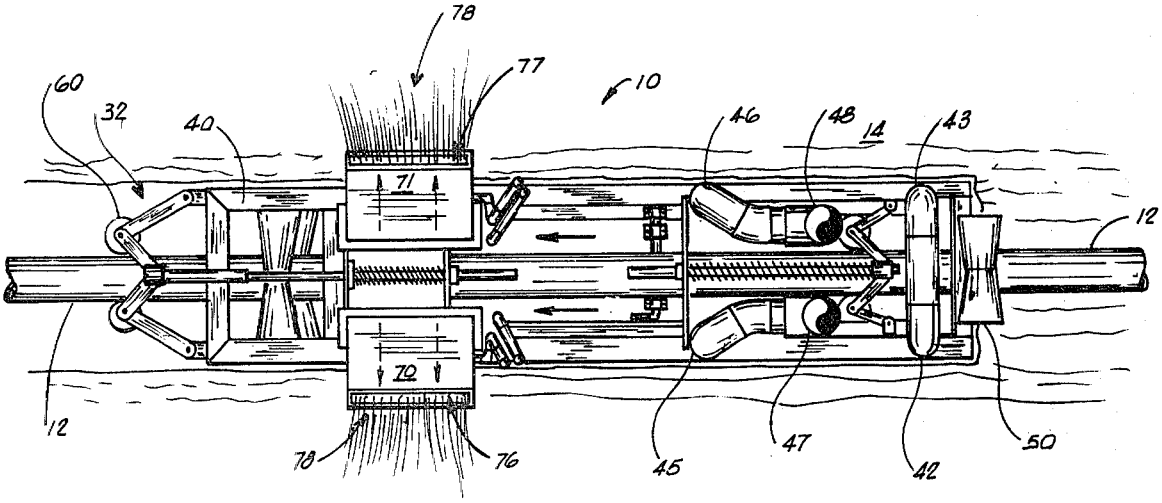
FIG. 3 is a top view of the preferred embodiment of the apparatus of the present invention.

FIGS. 1–3 illustrate best the preferred embodiment of the apparatus of the present invention designated generally by the numeral 10, FIGS. 1–3.

Jet sled 10 provides generally a supportive structural frame 40 adapted for undersea towing by a dredge, pull barge, or the like. Frame 10 can be of welded structural steel for example, and provides a central pipeline passageway allowing a pipeline to be buried to pass therethrough during the burying operation. In FIGS. 2 and 3, pipeline 12 occupies generally the central pipeline passageway.

In FIG. 1 barge 16 indicates a suitable pull barge, lay barge, or the like, which can tow sled 10 by means of tow line 22, which can be attached to sled 10 for example by means of a pull eye (not shown) welded or otherwise connected to frame 40. Connected to frame 40 are left and right jetting leg portions 42, 43 which are placed at opposite sides of frame 40 and disposed for jetting action on opposite sides of a pipeline 12, which will be laid in trench 32 formed by sled 10. Air lift conduits 70, 71 remove spoil and like material cut from the sea bed by left and right jetting legs 42, 43 as will be described more fully hereinafter.

In FIG. 1 there is seen a general view of the preferred embodiment of the apparatus of the present invention as pulled by barge 16. Barge 16 is a conventional type lay barge, pull barge, or the like having supports 18, 20 for lifting and lowering pipe or a pipeline portion to be laid, and is further steadied and pulled by means anchor lines 30, which can be equipped with winches (not shown).

Pipeline 12 is seen in FIG. 1 having enlarged cathodic protection 13 which produce bumps in the pipeline that must pass through sled 10 as will be described more fully hereinafter.

Water lines 24, 26 lead from barge 16 to sled 10 and provide a means for pumping pressurized fluid such as sea water through lines 24, 26 to sled 10 where water will be pumped through left and right jetting legs 42, 43 for subsequent discharge through high pressure nozzles 49, which will effect a cutting of the sea bed and a formation of a trench 32, as is desirable. Such cutting or jetting legs 42, 43 and nozzles 49 are known in the art and are shown for example in U.S. Pat. No. 3,368,358.

Also provided is an air supply hose 28, which transmits pressurized gaseous fluid such as air to sled 10 where it will be injected through air supply lines **29*a* to air lift conduits 70, 71. Air injected into air lift conduits 70, 71 at intakes 72, 74 will enhance removal of solid material, spoil, and like cutting as the air moves upwardly under buoyant force, hydraulically creating a flow of air and water which conveys the cuttings to discharges. (see FIG. 4**).

Left and right jetting legs 42, 43 are comprised generally of left and right conduits 45, 46 which provide hose attachments 47, 48 which can be for example temporary connections, such as threaded connections which are known. Nozzles 49 can be threadably attached to conduits 45, 46 and are preferably oriented upwardly, as shown in FIG. 2. If desirable, a second set of nozzles 49 can be directed inwardly to enhance the break up of soil material or spoil, which has been cut by jetting legs 42, 43. In FIG. 2 nozzles **49*a* represent a plurality of nozzles on conduits 45, 46 which are directed inwardly at a direction substantially perpendicular to pipeline 12 and facing the inner portion of trench 32. It will be appreciated by one skilled in the art that any material cut by nozzles 49*a* as sled 10 is advanced in the direction indicated by arrow 11 in FIG. 2**.

In FIG. 2 there can be seen a trench 32, which is cut by sled 10 and in which sled 10 rests with its bottom portion **40*a* resting on the floor 33 of trench 32**.

FIGS. 2 and 3 further show support rollers, 50, 60. Front and rear support rollers 50, 60 respectively are adjustable and expand allowing cathodic protection 13 (see FIG. 6) to pass therethrough. Also provided are fixed rollers 61, 62 and 64, 66 which are generally spaced so as to allow any enlargement as cathodic protection 13 to pass therethrough. The construction of expandable rollers 50, 60 will be discussed more fully hereinafter.

Air lifts 70, 71 provide a conduit through which soil material which is cut and is generally termed as "spoil" in this application, to be removed from the trench prior to the placement of pipeline 12 thereinto.

It should be understood that that term "spoil" as used herein is defined to be any material cut from the sea bed during the formation of a trench including clay, sand, soil, shell, and like materials.

Figure 4:
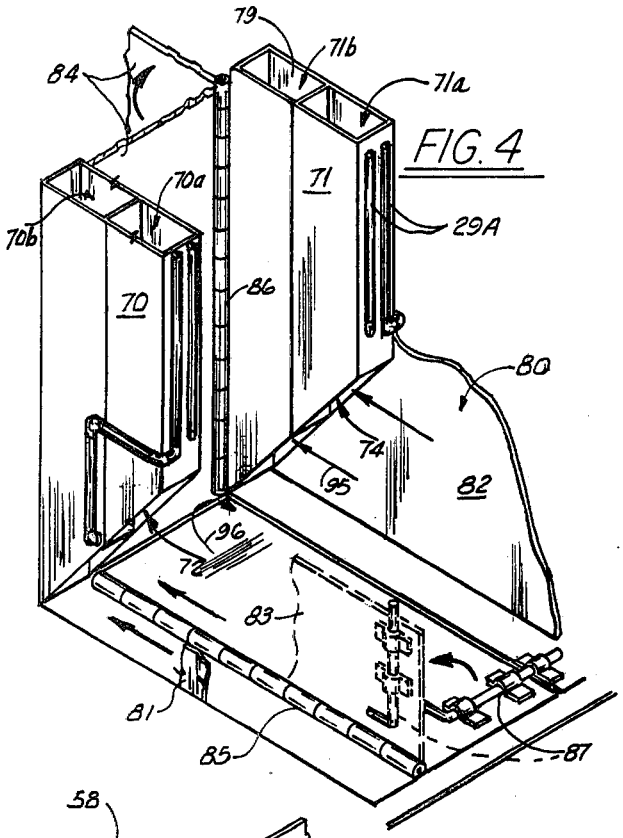
FIG. 4 is a partial perspective view of the preferred embodiment of the apparatus of the present invention illustrating the air lift conduit intake and spoil collection scoop portions thereof.

Air lift conduits 70, 71 provide air lift spoil intakes 72, 74 as best seen in FIG. 4. Note that each intake 72, 74 is forward facing and provides a bevelled leading edge with respect to the floor 33 of trench 32. These bevelled intakes 72, 74 face forwardly so that spoil material will be directed into intake 72, 74 as sled 10 moves forwardly in the direction of arrow 11. In the preferred embodiment the angle of bevel provided to each air lift spoil intake 72, 74 is between thirty and sixty degrees (30°60°).

FIGS. 2 and 3 show spoil discharges 76, 77. Note that the upper portion of each air lift 70, 71 is curved (see FIG. 1) so that spoil discharged through discharges 76, 77 is laterally removed from pipe 12 and trench 32. 78 indicates in FIG. 3 spoil discharged from air lifts 70, 71. Arrows 95 indicate generally the path of travel of spoil and air mixed within each air lift 70, 71 and discharged through spoil discharges 76, 77. The air-spoil mixture 78 which moves upwardly through lifts 70, 71 as indicated by arrows 95 is mixed at the intake 72, 74 portions of each air lift 70, 71 as air is discharged through air lines **29*a* at discharge ports 29*b*. In the preferred embodiment, four discharge lines 29*a* are provided, two for air lift 70 and two for air lift 71. Note in FIG. 4 that each air lift 70, 71 is divided by means of baffle 79 into ducts 70*a*, 70*b*, and 71*a*, 71*b* respectively. It is provided and preferred that one air discharge line 29***a* will discharge through a discharge port 29*b* into each duct 70*a*, 70*b*, and 71*a*, respectively.

A spoil collection scoop means mounted generally below pipeline 12 at scoop 80 surrounds the spoil intake 72, 74 portions of air lifts 70, 71. In FIG. 4, there can best be seen spoil collection scoop 80 which is comprised generally of side walls 81, 82, floor 83*a* and bottom door 83, and a rear door 84 portion. Thus, a four sided scoop is provided immediately adjacent intake 72, 74 portions of air lifts 70, 71. This is desirable as spoil material or like cuttings, which is also referred to in the art as the "plug" is directed to and collected in a confined space enhancing removal of the plug and denying its access to the trench 32 even after the sled passes. It will be appreciated that side walls 81, 82, floor 83*a*, and bottom door 83, and rear door 84 combine to form a multi-sided confinement to soil cuttings with the intake portions 72, 74 of air lifts 70, 71 being placed within the scoop 80. It will further be appreciated that the bevelled openings provided by each spoil intake 72, 74 give a vertically transending variable elevation opening, which collects soil at bottom door 83 and upwardly towards the top of scoop 80. It will be appreciated that this construction allows soil to be directed into and transmitted through lifts 70, 71 at different levels once collected within scoop 80, the intake 72, 74 having a variable elevation.

Note that bottom door 83 and rear door 84 are movably and removably mounted to frame 40 by means of bottom and rear door hinges 85, 86 respectively. Bottom door and rear door latches 87, 88 respectively are provided with a second rear door latch 89 also provided if necessary. Rear door latches 88, 89 are structural members which brace to rear door 84 to retain rear door in a closed position during operation. Each door 83, 84 can be removed from its attachment to sled 10 by means of pins 90, 91. It will be appreciated that each pin provides a handle 90*a*, 91*a* which allows an individual to grip and remove the pin from its attachment at hinges 85, 86.

Figure 5:
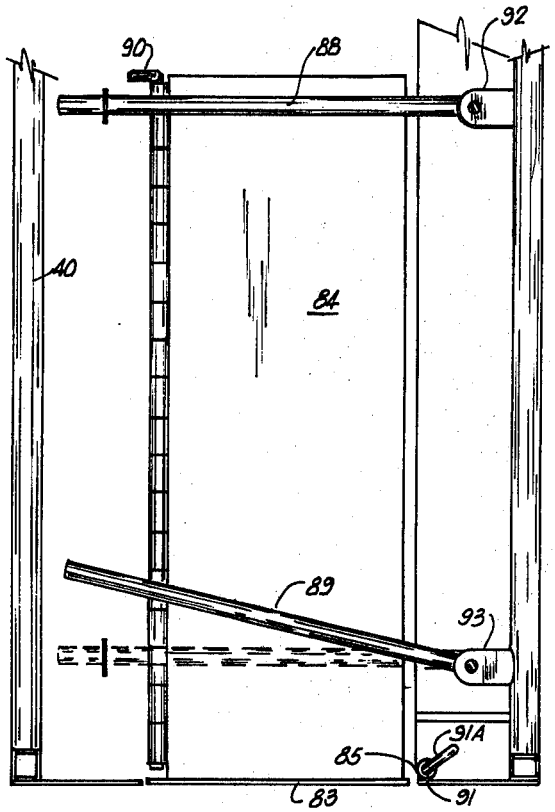
FIG. 5 is a partial rear view of the preferred embodiment of the apparatus of the present invention illustrating the rear door and bottom door portions of the spoil collection scoop.

FIG. 5 shows a detailed view of rear door 84. Note that brackets 92, 93 provide an attachment for latches 88. 89 in a pivotal fashion. Rear door 84 is generally vertical and closes off access to trench 32 by soil cuttings, spoil and like excavation material. Door 84 can intersect vertical sidewalls 81, 82 at substantially right angles as well as intersecting bottom door 83 at substantially right angles. A four sided "partial box" is thus formed. Since bottom and rear doors 83, 84 are removable, placement of jet sled 10 on pipeline 12 prevents no problem.

In FIGS. 2, 3 and 4, arrows 95 indicate the flow of soil cuttings or spoil after removal from the sea bed by jetting legs 42, 43, further agitation and breakup by nozzles 49*a* and collection by scoop 80. Arrows 96 which are curved in FIG. 4 illustrate the fact that spoil passing intakes 72, 74 will be prevented from escape from scoop 80 by rear door 84.

Doors 83, 84 are removably attached by means of pins 90, 91. This is important as removal of doors or their movement between open and closed positions is necessary in order to mount or dismount as desired jet sled 10 on pipeline 12 during the burying operation.

A diver would for example open doors 83, 84 prior to placement on pipeline 12. After such placement and prior to trench excavation, doors 83, 84 would be latched as shown in their closed positions (see FIGS. 4 and 5). In FIG. 4, the open positions of doors 84, 85 are shown in phantom lines.

Figure 6:
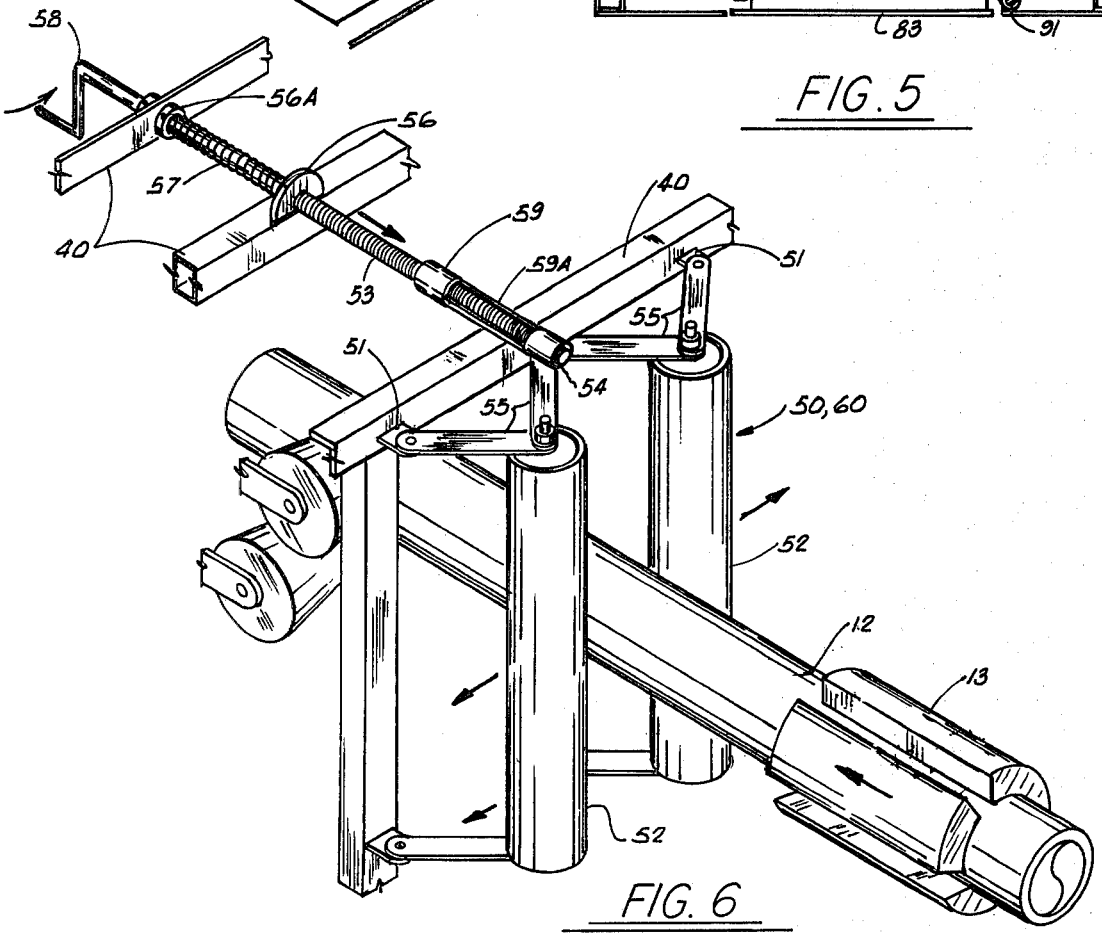
FIG. 6 is a partial perspective view of the preferred embodiment of the apparatus of the present invention illustrating the roller support portion thereof.

FIG. 6 best shows the construction of forward and rear roller support members 50, 60. It should be understood that rear and forward roller supports 50, 60 are substantially identical in construction and only rear roller support 60 will be described herein. Roller support 60 is comprised of a plurality of generally vertically mounted rollers 52 which are attached by means of brackets 51 and arms 55 to frame 40. Brackets 51 can be welded for example with arms 55 being pivotally attached to brackets 51 at one end portion and rollers 52 at the other end portion. Rollers 52 can be any conventional pipeline roller material such as hardened rubber, metal, or plastic having a central shaft of preferably steel which can be attached as shown in the drawings by bolting for example to link arms 55.

A shaft 53 movable with respect to frame 40 attaches at one end portion to female connection 59 on push rod 59*a*. Push rod 59*a* attaches at 54 to arms 55 and moves rollers 52 inwardly and outwardly (see arrows FIG. 6) responsive to rotation of crank 58. It will be appreciated then that the overall combined length of shaft 53 and pushrod 59*a* can be changed and adjusted between point of attachment 54 and crank 58. Since shaft 53 is threaded and cooperates with the female threads of push rod 59, it moves rollers inwardly and outwardly responsive to rotation of crank 58. Braces 56, 56*a* provide bracing to shaft 53 as it passes over frame 40, with shaft 53 slideably mounted in braces 56, 56*a*.

A spring 57 attaches around shaft 53 as shown in FIG. 6. Shaft 53 will slide through its brace mounts 56, 56*a* of frame 40. It will be appreciated that rollers 52 can move outwardly, moving shaft 53 toward rollers 52 compressing spring 57. In this way, cathodic protection 13 can pass through rollers 52 as they will adjust as needed. Further, it will be appreciated that adjustability is provided to roller 50, 60 which allows it to be fitted to any size pipe.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as the invention is:

1. A pipe burying apparatus comprising:

a. a frame;

b. means on said frame adapting said frame for undersea towing;

c. left and right jetting means on said frame for cutting at least the left and right side walls of an undersea pipe trench as said frame is towed;

d. left and right air lift conduit means, each providing spoil intake and spoil discharge portions for removing soil cuttings from the trench cut by said jetting means, said spoil intake portions being placed generally behind and between said left and right jetting means;

e. spoil collection scoop means surrounding said spoil intake portions on at least four sides including at least the rear side thereof for collecting soil cuttings about said spoil intake portions of said left and right air lift conduit means, said spoil collection means having independently movable rear and bottom door portions which move to a first open position to allow placement of said frame about a pipeline to be buried, and subsequent closure of said rear and bottom door portions after said frame is placed about a pipeline to be buried.

2. The pipe burying apparatus of claim 1, wherein said intake portions are placed at least in part at the lowermost portion of said scoop means.

3. The pipe burying apparatus of claim 1, wherein said frame comprises left and right frame members and said left and right jetting means are attached respectively on said left and right frame members, each of said left and right frame members providing a substantially vertical side collection wall laterally outside of said spoil portion.

4. The pipe burying apparatus of claim 1, wherein said intake portions are placed during operation at the rearmost portion of said scoop means.

5. A pipe burying apparatus comprising:

a. a frame, said frame comprising left and right frame members, each of said left and right frame members providing a substantially vertical side collection wall;

b. means on said frame adapting said frame for undersea towing;

c. left and right jetting means on said frame attached respectively to said left and right frame members, for cutting at least the left and right sidewalls of an undersea pipe trench as said frame is towed;

d. left and right airlift conduit means, each providing spoil intake and spoil discharge portions for removing soil cuttings from the trench cut by said jetting means, said spoil intake portions being placed generally behind and between said left and right jetting means;

e. spoil collection scoop means surrounding said spoil intake portions on at least four sides including at least the rear side thereof for collecting soil cuttings about said spoil intake portions of said left and right airlift conduit means, said spoil collection means having independent movably rear and bottom door portions which open to allow placement of said frame about a pipeline to be buried, wherein said rear door is placed generally behind said spoil intake with respect to the direction of flow of said frame, and extends in a generally vertical direction to said bottom door and in lateral side directions to said side walls.

6. The pipe burying apparatus of claim 5, wherein there is further provided brace means on said frame and behind said rear door with respect to the direction of movement of said frame when a pipe is being buried for retaining said rear door in a closed position.

7. The pipe burying apparatus of claim 6, wherein said brace means comprises at least one structural member mounted on said frame behind said door.

8. A pipe burying apparatus comprising:

a. a frame;

b. means on said frame adapting said frame for undersea towing;

c. left and right jetting means on said frame for cutting at least the left and right sidewalls of an undersea pipe trench as said frame is being towed;

d. left and right airlift conduit means, each providing spoil intake and spoil discharge portions for removing soil cuttings from the trench cut by said jetting means, said spoil intake portions being placed generally behind and between said left and right jetting means, and said spoil intake portions are variable elevation openings in said air lift conduit means;

e. spoil collection scoop means surrounding said spoil intake portions on at least four sides including at least the rear side thereof for collecting soil cuttings about said spoil intake portions of said left and right air lift conduit means, said spoil collection means having independently movable rear and bottom door portions which open to allow placement of said frame about a pipeline to be buried, and said intake portions are placed during operation at the lowermost portion of said scoop means; and f. roller means on frame for movably supporting said frame on the pipeline to be buried, said frame being supported by said roller means generally above said scoop means with the supported pipeline being above said scoop means when passing adjacent thereto.

9. A pipe burying apparatus comprising:

a. a frame having a central pipeline passage allowing a pipeline to be buried to pass therethrough during the burying operation;

b. means on said frame adapting said frame for undersea towing;

c. left and right jetting means on said frame and on the left and right side respectively of said central pipeline passageway for cutting a trench in the sea bed with subsequent placement of a pipeline to be buried therein;

d. left and right air lift conduit means on each providing spoil intake and spoil discharge portions for removing soil cuttings from the trench cut by said jetting means, said spoil intake portions being placed generally behind and between said left and right jetting means; and e. spoil collection scoop means mounted on said frame and below said central pipeline passageway portion of said frame and surrounding on at least the bottom, sides and rear portions of said intake portions for collecting soil cuttings, said spoil collection means having independently movable rear and bottom door portions, each of which door portions is movable on said frame between open and closed positions, each of said doors being removable from said frame;

f. front and rear roller means on said frame for supporting a pipeline to be buried in said central pipeline passageway; and g. crank means cooperatively connected to each of said roller means respectively for adjustably spacing said pair of rollers.

10. The pipe burying apparatus of claim 9 wherein each of said roller means is expandable at least in part, allowing an increased diameter section of a pipeline being buried to pass therethrough.

11. The pipe burying apparatus of claim 10 wherein each of said roller means comprises a pair of spaced rollers which are movable and adjustably mounted on said frame.

* * * * *